United States Patent [19]

Shida et al.

[11] 4,312,058

[45] Jan. 19, 1982

[54] ELECTRONIC WATCH

[75] Inventors: Masaharu Shida; Akira Torisawa; Makoto Ueda, all of Tokyo, Japan

[73] Assignee: Kabushiki Kaisha Daini Seikosha, Tokyo, Japan

[21] Appl. No.: 898,397

[22] Filed: Apr. 20, 1978

[30] Foreign Application Priority Data

Apr. 23, 1977 [JP] Japan ..... 52-047096

[51] Int. Cl.[3] ..... G04B 9/00; G04B 19/04; G04F 5/00

[52] U.S. Cl. ..... 368/66; 368/80; 368/85; 368/160

[58] Field of Search ..... 58/23 R, 23 D, 23 A, 58/23 BA, 152 H; 318/696, 685; 368/66, 76, 80, 85-87, 203, 204, 217-219; 340/373, 636, 663, 672

[56] References Cited

U.S. PATENT DOCUMENTS 4,028,880 6/1977 Veda ..... 340/636

4,114,364 9/1978 Takahishi ..... 58/23 BA 4,129,981 12/1978 Nomoru et al. ..... 58/23 BA

*Primary Examiner*—Vit W. Miska

*Attorney, Agent, or Firm*—Robert E. Burns; Emmanuel J. Lobato; Bruce L. Adams

[57] ABSTRACT

In an electronic watch having a stepping motor, a battery voltage detecting circuit, a rotation detecting circuit for indicating rotation or non-rotation of the stepping motor and a motor driving power control circuit for applying a higher power drive pulse to the motor than a normal drive pulse upon detection of non-rotation, the operation of the rotation detecting circuit is inhibited upon indication of a low battery voltage condition and the motor is driven continuously with the higher power drive pulses for the extent of the battery low voltage condition. In this way, the electronic watch can be operated stably when the battery is at the end of its life and operated with lower power consumption during the time when the battery is operated at full voltage.

8 Claims, 11 Drawing Figures

ELECTRONIC WATCH

BACKGROUND OF THE INVENTION

The present invention relates to an improvement in an electronic watch which has driving power automatic control means for a stepping motor for the purpose of reducing the power consumption of the stepping motor to provide an electronic watch which can be operated stably at the end of its battery life, and operated with lower power consumption.

The display mechanism of an conventional crystal watch of the analog type now in use is constructed generally as shown in FIG. 1. The output of the motor consisting of a stator 1, a coil 7 and a rotor 6 is transmitted to different wheels 2, 3, 4 and 5 and a second pointer, a minute pointer, an hour pointer as well as a calender are driven by the wheels together with other wheels not shown. FIG. 2 shows a circuit construction of the conventional electronic watch. A signal of about 32 KHz from an oscillating circuit 10 is converted into a second signal by a frequency dividing circuit 11. The second signal is further converted into a signal having either a 1.8 msec or 2 sec period by pulse combining circuit 12. To input terminals 15, 16 of drive inverters 13*a* and 13*b* is applied a signal having the same pulse period and width but dephased by one second, so that an inverted pulse alternating every one second is applied to a coil 14. The rotor 16, magnetized in two poles, begins to rotate in one direction. The coil current wave shape with this case is shown in FIG. 3.

In the meantime, the drive pulse width in the electronic watch according to the conventional art, i.e., 7.8 msec in the conventional watch, is designed in such a way that the factors such as coil resistance, number of turns, and size of the stepping motor are suitably selected so as to drive the stepping motor in a stable condition under worst care conditions, such as when the load on the wheels increases the watch is placed in a magnetic field, the internal resistance of the watch battery strikingly increases due to very low temperature, or the battery voltage lowers because of exhaustion of the battery. One drawback of conventional watches is that when a large torque is not necessary, the drive pulses of fixed pulse width cause excess consumption of the battery.

To overcome such drawbacks as described above, a method for driving a stepping motor has been proposed recently wherein detecting means for detecting the operating condition of the stepping motor is provided so as to change the drive power (generally, the driving pulse width) continuously or steppingwise at minimum power.

SUMMARY OF THE INVENTION

The object of the approaching present invention is to provide an electronic having a stepping motor rotation detecting means so as to operate the watch in a stable condition at the exhaustion of the battery, especially, with a driving power automatic control system of the correction driving pulse type so as to prevent waste of power.

The correction pulse driving system which uses a rotor rotation detecting device of a stepping motor will be explained as an embodiment of the power automatic control means.

The gist of the operation is as follows: in the normal condition, the stepping motor is driven by a pulse having a shorter pulse width than that of the conventional type, after this, a detecting pulse is applied to the coil of the stepping motor in order to detect whether the rotor rotated or not, rotation on non-rotation of the rotor is detected by the voltage level produced across a resistor connected to the coil in series, and if the rotor is not rotated, the stepping motor is driven again by a correction pulse with a wider pulse width so as to correct the condition.

DETAILED DESCRIPTION OF THE INVENTION

Before entering into a detailed explanation of the operation of the circuit, the principle of the rotation detection will be explained.

The rotation of the stepping motor used in the electronic watch according to the present invention is based on the following principle.

Figure 4:
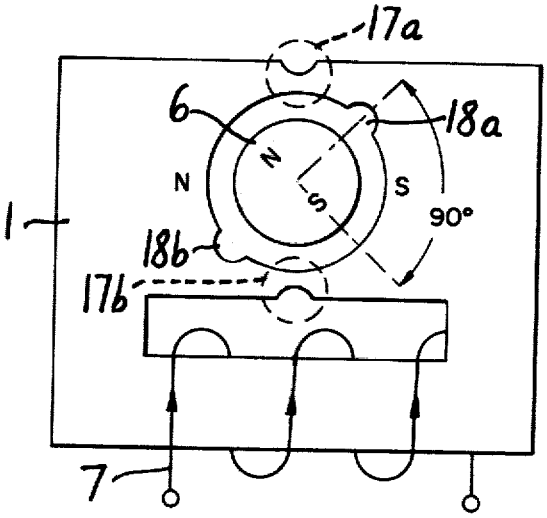
FIGS. 4 through 6 show operations of the stepping motor, respectively.

Referring to FIG. 4, reference numeral 1 represents a stator formed as an integral member or body in which saturable magnetic paths 17*a*, 17*b* are constructed. The magnetic paths are magnetically coupled to a magnetic core portion wound by coil 7. A pair of notches 18*a*, 18*b* are formed in the stator so as to determine the rotating direction of the rotor 6 which is magnetized in the radial direction with two poles. FIG. 4 shows a condition just after current is applied to the coil 7. However, when current is not applied to the coil, the rotor 6 is stationed at the position where the angle between the notches 18*a*, 18*b* and the magnetic poles of the rotor is approximately 90°. In this condition, when the current is flowing in the direction of the arrow through the coil 7, the magnetic poles are generated in the stator as shown in FIG. 4 and the rotor 6 starts rotating clockwise due to repulsion. When the current flowing through the coil 7 is interrupted, the rotor 6 comes to a stand still at the opposite condition as that shown in FIG. 4. After this, by the current flowing in the opposite direction through the coil 7, the rotor 6 continues to rotate clockwise.

Figure 1:
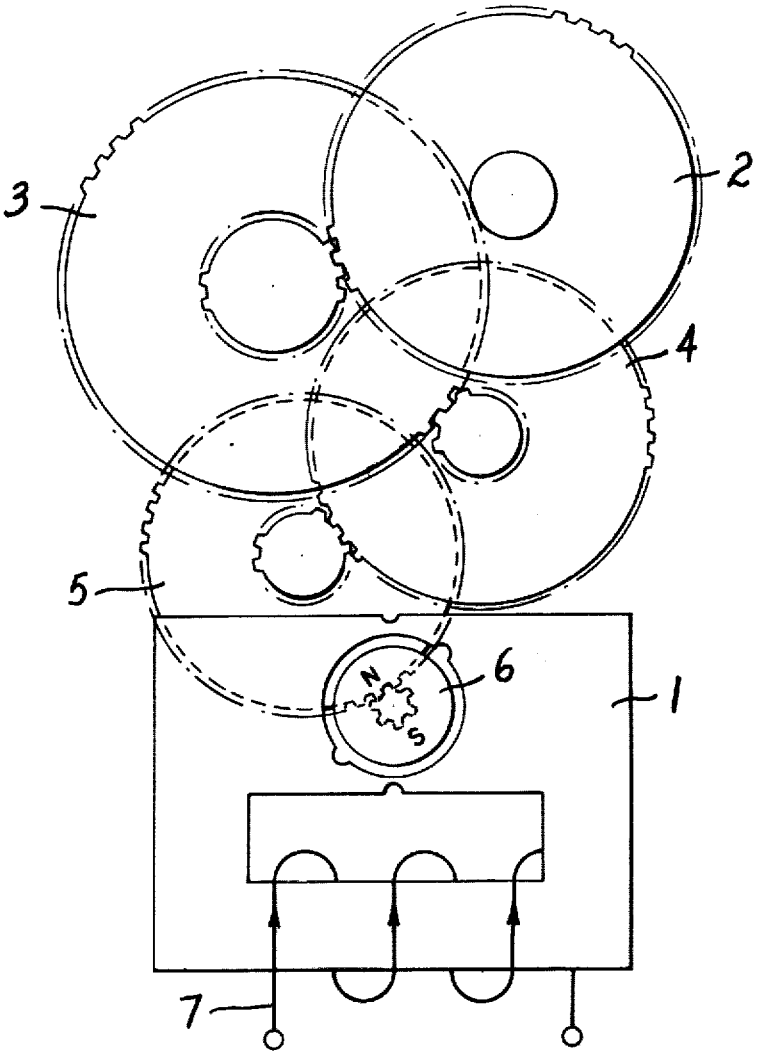
PRIOR ART FIG. 1
FIG. 1 shows an example of a display mechanism for an analog type electronic watch.
Figure 2:
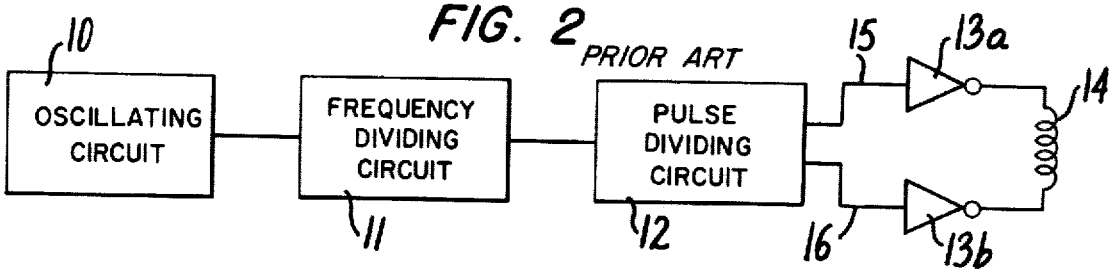
FIG. 2 PRIOR ART
FIG. 2 shows a circuit construction of a crystal oscillation electronic watch.
Figure 3:
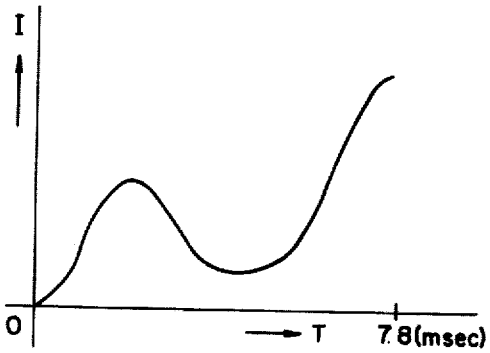
FIG. 3 PRIOR ART
FIG. 3 shows a current waveform of the conventional stepping motor.

Since the stepping motor used in the electronic wrist watch in this embodiment is constructed with the stator comprising an integral body having the saturable portions 17*a*, 17*b*, the current waveform when the current flows through the coil 7 represents the characteristic with gradual rising as shown in FIG. 3. This is because the magnetic resistance of the magnetic circuit viewed from the coil 7 is very low before the saturable portions 17*a*, 17*b* of the stator 1 saturate and as a result, the time constant $\tau$ of the series circuit of resistor r and the coil 7 becomes large: This can be expressed in the following equation.

$$\tau = L/R,\ L \doteq N^2/R_m$$

Therefore, $$\tau = N^2/(R \times R_m)$$

where,

L: inductance of the coil 7

N: number of turns of the coil 7

$R_m$: magnetic resistance

When the saturate portions 17*a*, 17*b* of the stator 1 saturates, the permeability of the portion saturated is the same as that of the air, so that the magnetic resistance $R_m$ increases and the time constant $\tau$ of the circuit becomes small as shown in FIG. 3. As a result, the current wave suddenly rises. The detection of the rotating condition of the rotor 6 used in the electronic watch according to the present invention uses the difference in the time constants of the series circuit of the resistor and the coil. Next, the reason for yielding the difference in the time constants will be explained in conjunction with FIGS. 5–7.

Figure 5:
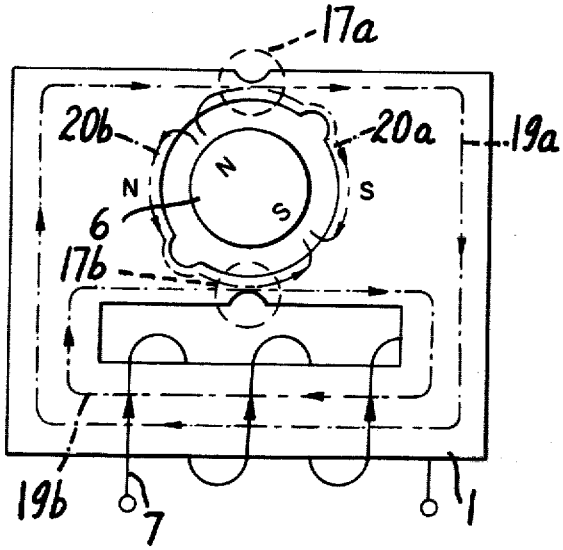

FIG. 5 shows a condition of the magnetic fluxes just after current is applied to the coil 7, and the poles of the rotor 6 are placed in the position which enable them to rotate the rotor 6. The magnetic flux lines 20*a*, 20*b* show how the magnetic fluxes are produced from the rotor 6. In practice, although there exists a flux crossing the coil 7, this is omitted from the showing. The magnetic flux lines 20*a*, 20*b* are directed to the arrow shown in FIG. 5 at the saturable portions 17*a* and 17*b* of stator 1. The saturable portions 17*a*, 17*b*, in most cases, have not yet saturated. In this condition, the current is flowing through of coil 7 in the direction of arrow so as to rotate the rotor clockwise. The magnetic fluxes 19*a* and 19*b* produced by the coil 7 are strengthened by the fluxes 20*a*, 20*b* produced by the rotor 6 at the saturable portions 17*a* and 17*b*, so that the saturable portions 17*a*, 17*b* of the stator 1 will promptly saturate. Afterwards, the magnetic flux which has a sufficient strength for rotating the rotor 6 is produced in the rotor 6, but this is omitted from the drawing in FIG. 5. The waveform of the current flowing through the coil at this time is shown as numeral 22 in FIG. 7.

Figure 6:
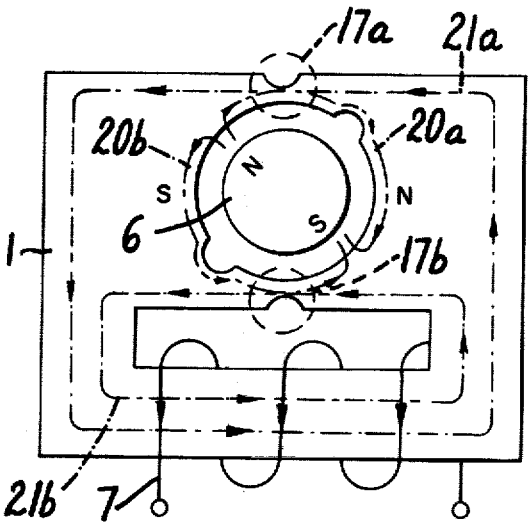

FIG. 6 shows a condition of the flux in which the current has flowed through the coil 7 when the rotor 6 could not rotate for some reason and the rotor returned to the original position. In general, for the purpose of rotating the rotor 6, the current must flow through the coil in the opposite direction to the arrow, namely, in the same direction as the current shown in FIG. 5. However, since alternating current which changes its direction one every one revolution is applied to the coil 7, the condition such as this will be brought about unless the rotor 6 can rotate. In this case, since the rotor 6 could not be rotated, the direction of the flux produced by the rotor 6 is the same as that shown in FIG. 5. Since the current is flowing in the opposite direction against the direction shown in FIG. 5, the direction of the magnetic fluxes becomes that shown as 21*a* and 21*b*. At the saturable portions 17*a* and 17*b* of the stator 1, the magnetic fluxes produced by the rotor 6 and the coil 7 cancel each other out. To saturate the saturable portions of the stator 1, much more time is necessary. This current waveform condition is shown as numeral 23 in FIG. 7.

Figure 7:
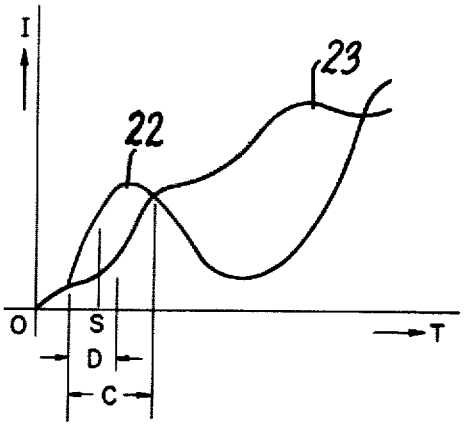
FIG. 7 shows an example of a current waveform of the stepping motor.

According to this embodiment, in the stepping motor wherein the diameter of the wire of the coil is 0.23 mm, the number of turns is 10,000, the D.C. resistance of the coil is 3 KΩ, the diameter of the rotor is 1.3 mm and the minimum width of the saturable portion is 0.1 mm, the time difference D in FIG. 7 to saturate the saturable portion 17 of the stator 1 was 1 msec. It will be understood that, during the extent of C, the inductance of the coil is small when rotating the rotor 6, and the inductance is large when the rotor 6 is not rotating. In the stepping motor having the above-mentioned specification, the equivalent inductance during the time of D was 5H at the rotating current waveform 22, and the equivalent inductance was 40H at the non-rotating current waveform 23.

For example, it is easily possible to detect the change of the inductance by detecting the voltage produced across the detecting resistor element by using the threshold $V_{th}$ of a C-MOS inverter, namely, the value of voltage $\frac{1}{2}V_D$ when the inductance is connected to the D.C. resistance RΩ of the coil and the resistor having the resistance value of rΩ as the passive element for detecting, and it is connected to a power supply $V_D$. Since the voltage produced across the resistor having the value of rΩ is $\frac{1}{2}V_D$, the following equation is obtained:

$$(\tfrac{1}{2})V_D = r/(R+r)\cdot[1-\exp\{-(R+r)\cdot + /L\}]$$

According to the equation, when R is 3 KΩ, t is 1 msec and L is 40H, r is equal to 29 KΩ. Also, in the case of the current waveform 22 shown in FIG. 7, the saturation time is 0.4 msec approximately. Therefore, assuming that R is 3 KΩ, t is 0.6 msec and L is 5H, r becomes 7.1 KΩ using the above equation. That is, it is possible to detect when the range of the resistance value of the resistor element for detecting is from 7.1 KΩ to 29 KΩ. This result agreed with the result of experiment.

The operation principle of the rotation detecting was explained in the foregoing. Generally, when driving power automatic control of the stepping motor is used, the circuit detecting the analog quantity by any means is necessary. In the above-mentioned embodiment, the CMOS inverter connected to the terminal of the resistance element for detecting corresponds to this circuit.

In the meantime, it is difficult to maintain the detecting characteristic of the analog circuit during changes of the voltage of the power source. Therefore, when the voltage of the power source is decreased, the error detecting operation occurs frequently, and it is difficult to operate the driving power automatic control device in a stable condition. More especially, the correction driving system already explained is disadvantageous in that power consumption is increased as compared with the conventional fixed pulse width driving when the driving force of the stepping motor is decreased by the decrease of the source voltage and the correction driving is repeated many times.

Therefore, the present invention comprises the system wherein, when the voltage of the battery is decreased, the operation of the driving power automatic control means is inhibited by utilizing the battery voltage detecting circuit of the battery life warning circuit which is generally used in recent electronic watches, and the stepping motor is driven by a pulse having a fixed pulse width.

Figure 8:
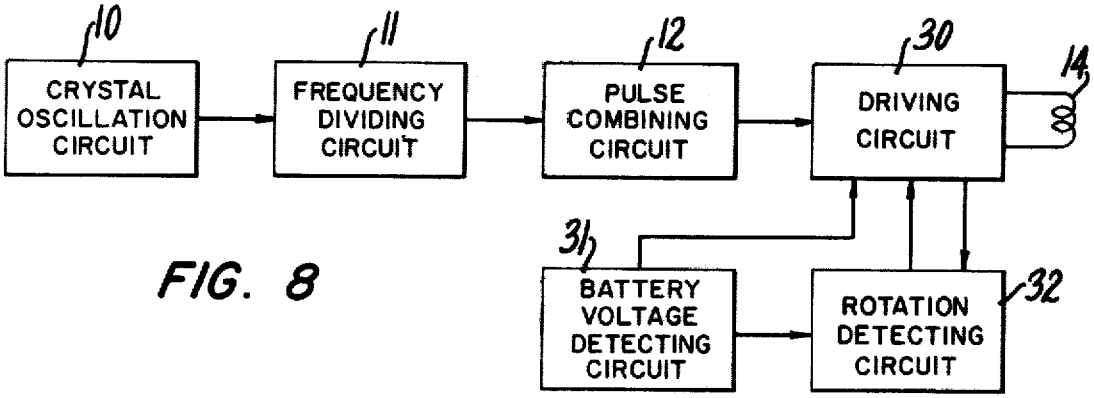
FIG. 8 shows a block diagram of the embodiment according to the present invention.

FIG. 8 shows the block diagram of the embodiment of the invention. The construction of a oscillation circuit 10, a frequency dividing circuit 11 and pulse combining circuit 12 are the same as the conventional ones. The driving circuit 30 is connected to a coil 14 of the stepping motor and, at the same time, the driving circuit 30 is connected to the rotation detecting circuit 32. The output of a battery voltage detecting circuit 31 is connected to the driving circuit 30 and the rotation detecting circuit 32.

Figure 9:
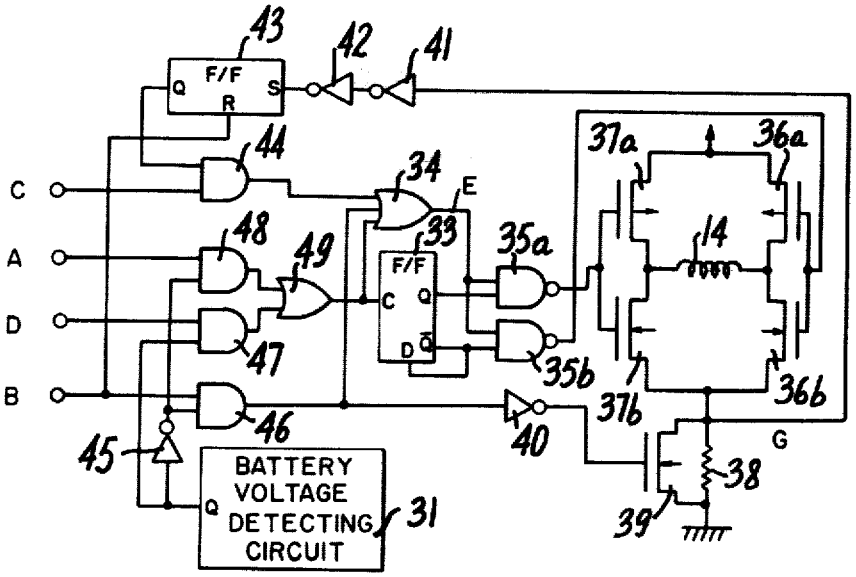
FIG. 9 shows an example of the construction of the embodiment in detail.

FIG. 9 shows a detailed construction of the driving circuit 30 and the rotation detecting circuit 32. It is easy to construct the pulse combining circuit 12 which produces the fixed pulse wave shape having a constant period by the combination of logic gates, so that the detailed construction thereof is omitted. Also, since the construction of the battery voltage detecting circuit 31 is unrelated to the present invention, only the function thereof will be explained hereinafter.

The driving circuit 30 consists of a driving portion comprising a D type flip-flop 33, an OR gate 34, NAND gates 35*a*, 35*b* and an output inverter formed from P-type and N-type MOSFETs 36*a*, 36*b*, 37*a*, and 37*b*, and a control portion comprising a RS type flip-flop 43 and an AND gate 44. The rotation detecting circuit 32 comprises a resistor 38, a N-type MOS FET 39, an inverter 40 and detection inverters 41 and 42. A control circuit according to the present invention is constructed by using AND gates 46, 47 and 48, and an OR gate 49.

The clock input terminal C of D type flip-flop 33 is connected to the output terminal of the OR gate 49, the output terminals Q and Q thereof are connected to the input terminals of NAND gates 35*a* and 35*b*, and the data terminal D is connected to the output terminal Q thereof.

The source terminals of the P-type MOS FET 36*a* and 37*a* are connected to the power source $V_{DD}$.

The set terminal S of the RS-type flip-flop 43 is connected to the output terminal of the inverter 42, the reset terminal R is connected to the input point B, and the output terminal Q is connected to the input terminal of the AND gate 44.

The basic operation of the driving portion will be explained hereinafter.

Since the data terminal D of the D-type flip-flop 33 is connected to the output terminal Q, the outputs Q and Q change their conditions every time one pulse is applied to the clock terminal C. For this, the signal from the output terminal E of the OR gate 34 is permitted to pass either the NAND gate 35*a* or 35*b* alternately, therefore, to both terminals of the coil 14, a voltage is applied alternately, so that the stepping motor is rotationally driven.

Next, the operation of the embodiment will be explained in detail.

The battery voltage detecting circuit 31 detects the voltage of the battery periodically. When the value of the voltage is larger than a predetermined value, the condition of the output Q is maintained at the "0" level, and when the value of the voltage is lower than a predetermined low voltage value, the condition of the output Q is maintained at the "1" level.

Figure 10:
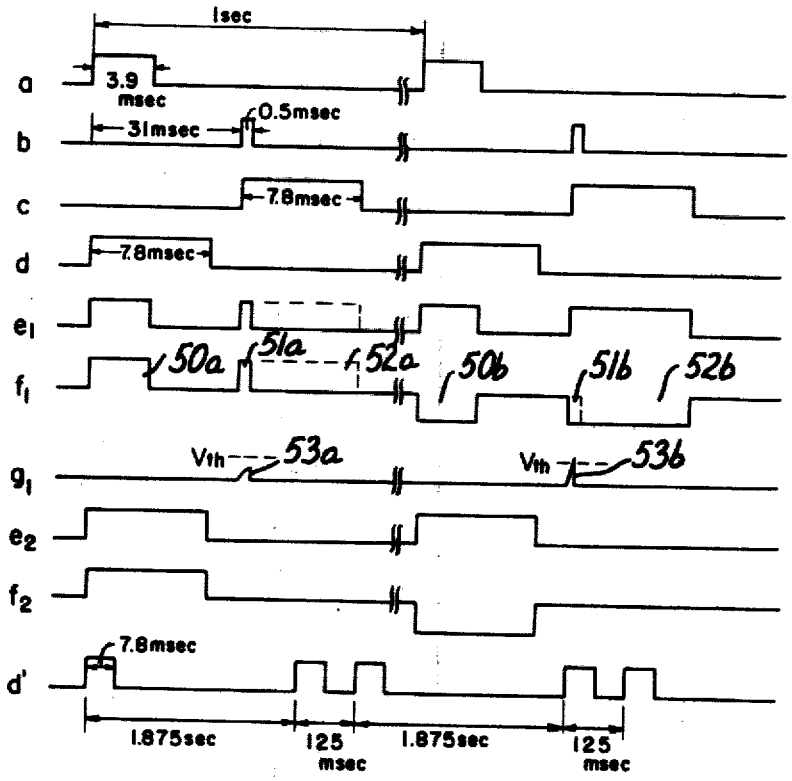
FIG. 10 shows a time chart.

The pulses shown by a, b, c and d in FIG. 10 are applied to the input points A, B, C and D from the pulse combining circuit 12, respectively. In the normal condition, since the output terminal Q of the battery voltage detecting circuit 31 is in the "0" level, the pulses a and b can pass through the AND gates 48 and 46, and the pulse d can not pass through the AND gate 47. They are combined by using the OR gates 49 and 34, as a result, a signal e, shown in FIG. 10 is produced at the point E. Since the signal changes its direction once every second and is applied to both terminals of the coil 14, the voltage difference across the coil 14 becomes the condition of $f_1$ shown in FIG. 10.

Figure 11:
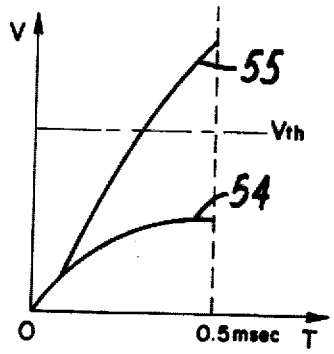
FIG. 11 shows an example of the voltage waveform across the resistor in the embodiment.

Assuming now that the rotor rotates by one step in the normal condition by applying the driving pulse 50*a* to coil 14, (at this time, the P-type MOS FET is in the ON condition and the resistor 38 is shortened, the voltage wave shape produced at the detection point G by the detecting pulse 51*a* becomes the waveform with a slow rise time as shown by 54 in FIG. 11 and 53*a* at $g_1$ in FIG. 10, as described in the principle of the rotation detecting circuit, and it is impossible to reach the detecting level $V_{th}$. Therefore, the RS flip-flop 43 is not set, so that the pulse C can not pass through the AND gate 44. As a result, the pulse 52*a* is not produced. If, for some reasons, the rotor could not be rotated by the driving pulse 50*b*, the voltage wave shape produced by the detecting pulse 51*b* at the detection point G becomes the waveform with a fast rise time as shown by 55 in FIG. 11 and 53*b* at $g_1$ in FIG. 10. Therefore, it is possible to reach to the detecting level $V_{th}$, and the detection signal 53*b* is produced. As a result, the correction driving pulse 52*b* is applied to the coil 14.

Assuming that the output Q of the battery voltage detecting circuit 31 goes to the condition of "1" by the decrease of the voltage of the battery, the AND gates 46 and 48 cut off the pulses a and b, and only gate 47 will pass the pulse d. To the RS flip-flop 43, only the reset signal is applied, so that the RS flip-flop is not set. Therefore, the pulse C can not also pass through the gate 44. As a result, the signal at the point E becomes the signal having the fixed wave shape as shown by $l_2$ which is equal to the pulse d applied to the input point D, so that the conventional fixed pulse width driving is carried out.

Now, the operating explanation has finished. Using a pulse changing every two seconds periodically as shown by d' in FIG. 10 instead of the pulse applied to the input point D, the embodiment can be used as the circuit which warns of the approaching exhaustion of the battery.

Thus, according to the present invention, it is possible to operate the stepping motor in a stable condition at the time of near exhaustion of the battery by changing the circuit, more especially, to prevent the power waste in the driving power automatic control system by correction driving, so that its effect is striking.

The present invention is applicable to a stepping motor having the construction different from above-mentioned construction or to a driving power automatic control means using different operation principle. The present invention is not restricted by the type of the stepping motor, or the operation principle and the construction of the driving power automatic control means.

We claim:

1. An electronic timepiece powered by a battery comprising: a stepping motor; an oscillating circuit for producing a time standard signal; a dividing circuit for dividing the time standard signal; a pulse combining circuit for combining the divided signals to produce normal drive pulses having a given pulse width and wider drive pulses having a pulse width wider than the given pulse width; a driving circuit for normally driving the motor with the normal drive pulses; a rotation detecting circuit for detecting rotation and non-rotation of the motor after the application of each of the normal drive pulses to the motor; a battery voltage detecting circuit for detecting when the voltage of the timepiece battery drops to a predetermined low voltage condition indicative of the approaching exhaustion of the timepiece battery; and means responsive to detection of a low voltage condition for inhibiting the operation of the rotation detecting circuit and for controlling the driving circuit to apply the wider drive pulses instead of the normal drive pulses to the motor for the duration of the low voltage condition.

2. An electronic timepiece according to claim 1; wherein said battery voltage detecting circuit includes means for producing an output signal when the voltage of the battery drops to the predetermined low voltage condition; and said driving circuit includes means operable in response to the output signal for applying the wider drive pulses to the motor and operable in the absence of the output signal for applying the normal drive pulses to the motor.

3. An electronic timepiece according to claim 2; wherein said rotation detecting circuit includes means responsive to the output signal from the battery voltage detecting circuit for inhibiting the operation of the rotation detecting circuit.

4. An electronic timepiece according to claim 1; wherein said battery voltage detecting circuit includes means for producing a first output signal when the voltage of the battery drops to the predetermined low voltage condition; said rotation detecting circuit includes means for producing a second output signal in response to detection of non-rotation of the motor, and means responsive to the first output signal for inhibiting the operation of the rotation detecting circuit; and said driving circuit includes means operable in response to either the first or second output signals for applying the wider drive pulses to the motor and operable in the absence of both the first and second output signals for applying the normal drive pulses to the motor.

5. An electronic timepiece according to claim 1; wherein the rotation detecting circuit comprises a resistor connected to the driving circuit, and a switching element connected to the resistor.

6. In an electronic timepiece powered by a battery: a stepping motor; a battery voltage detecting circuit for detecting when the voltage of the timepiece battery drops to a predetermined low voltage level indicative of the approaching exhaustion of the battery and for producing a corresponding first signal; a rotation detecting circuit for detecting non-rotation of the motor and for producing a corresponding second signal when non-rotation of the motor is detected; and motor driving power control means for normally applying lower power drive pulses to the motor to effect rotation of the motor and responsive to the first signal for inhibiting the operation of the rotation detecting circuit and applying higher power drive pulses instead of the lower power drive pulses to the motor to effect rotation of the motor for the duration of the low voltage level condition and responsive to the second signal for applying higher power drive pulses instead of the lower power drive pulses to the motor to effect rotation of the motor.

7. An electronic timepiece according to claim 6; including means for developing lower power drive pulses having a given pulse width and for developing higher power drive pulses having a wider pulse width than the given pulse width.

8. An electronic timepiece according to claim 6; wherein the rotation detecting circuit includes means for detecting a non-rotation condition of the motor after the application of each lower power drive pulse to the motor.

* * * * *